US006604568B2

(12) United States Patent
Bliss et al.

(10) Patent No.: US 6,604,568 B2
(45) Date of Patent: Aug. 12, 2003

(54) METHOD OF MANUFACTURING TITANIUM GOLF CLUB HAVING A STRIKING SURFACE FREE OF OXYGEN-STABILIZED ALPHA PHASE TITANIUM

(75) Inventors: John C. Bliss, Glendale, AZ (US); Gregory C. Sayler, Marysville, WA (US)

(73) Assignee: Kartsen Manufacturing Corp., Phoenix, AZ (US)

( * ) Notice: Subject to any disclaimer, the term of this patent is extended or adjusted under 35 U.S.C. 154(b) by 0 days.

(21) Appl. No.: 09/931,659

(22) Filed: Aug. 16, 2001

(65) Prior Publication Data

US 2003/0034142 A1 Feb. 20, 2003

(51) Int. Cl.[7] ..... B22D 27/00

(52) U.S. Cl. ..... 164/76.1; 164/55.1; 164/56.1; 148/669

(58) Field of Search ..... 164/76.1, 55.1, 164/56.1; 148/669

(56) References Cited

U.S. PATENT DOCUMENTS 3,769,101 A * 10/1973 Woodward ..... 148/669
4,076,254 A * 2/1978 Nygren ..... 273/173
5,056,705 A * 10/1991 Wakita et al. ..... 228/176
5,511,604 A * 4/1996 Ravenhall et al. ..... 164/97
6,270,422 B1 * 8/2001 Fisher ..... 473/223
6,381,828 B1 5/2002 Boyce et al. ..... 29/527.4

* cited by examiner

*Primary Examiner*—Tom Dunn
*Assistant Examiner*—I.-H. Lin
(74) *Attorney, Agent, or Firm*—Darrell Marquette; John D. Titus

(57) ABSTRACT

The present invention comprises a method of making a golf club head by casting a molten titanium alloy and thereafter removing the alpha case that is formed on the surface of the titanium by means of a conformal milling process. The conformal milling process uniformly dissolves the alpha case without distorting the underlying metal. The reduction in wall thickness caused by the conformal milling results in a concomitant reduction in the weight of the part without any loss in the critical impact strength of the part. In fact, impact strength is increased. This weight can then be redistributed as a supplemental weight member, which can be used to lower the center of mass of the club. The weight member can further be positioned on the sole plate or club body in such a way so as to permit fine tuning of the location of the center of mass of the club, as well as shaped so as to increase the polar moment of inertia of the club head about the golf club shaft.

4 Claims, 3 Drawing Sheets

METHOD OF MANUFACTURING TITANIUM GOLF CLUB HAVING A STRIKING SURFACE FREE OF OXYGEN-STABILIZED ALPHA PHASE TITANIUM

BACKGROUND OF THE INVENTION

This invention relates to the manufacture of golf club heads, specifically to the manufacture of golf club heads having a titanium striking surface.

Golf clubs commonly known as "woods" traditionally have a head made of a suitable wooden material such as maple or persimmon. These wooden club heads are usually solid and are shaped with their weight properly distributed about their center of gravity to maximize performance. More recently, so-called metal "wood" heads have been developed. These metal woods are formed of suitable metals such as steel or aluminum and, more recently, titanium. Metal wood clubs typically comprise a hollow shell having relatively thin walls including a thin front wall which is used to impact the golf ball. The pressure to obtain higher and higher performance out of these metal wood clubs has resulted in clubs designed with larger and larger head sizes and, in order to maintain proper swing weight, thinner and thinner walls.

Titanium has become the material of choice for ultra high performance metal woods. Titanium alloys usually have a modulus of elasticity (stiffness) that is lower than steel, but much higher than aluminum or magnesium. In comparison to aluminum and steel alloys, titanium alloys have a thirty percent or greater strength to weight ratio. Thus, manufacturing a metal wood from titanium gives the designers the ability to make a larger club head without compromise in strength or weight. Titanium, however, is not as easily manufactured and processed as steel or aluminum. High temperature processes such as casting, forging or heat treating must be carefully set up and controlled to prevent embrittlement that leads to rapid failure of the club head in service. Most titanium alloys are notch sensitive. Notch sensitivity means that tensile stress applied along a sharp inside corner will easily produce a crack that will propagate through the part resulting in a catastrophic failure.

Pure titanium appears in two forms. At room temperature a pure piece of titanium is a form where all of its atoms are arranged in a hexagonal close packed crystal structure. The hexagonal close packed crystal is called the "alpha phase" of titanium. If the alpha phase of titanium is heated to above 1620° F. the atoms rearrange from the hexagonal prism into a cubic pattern known as a "body centered cubic" crystal structure. This phase of titanium is referred to as the "beta phase."

When titanium is heated (e.g. during casting or welding) oxygen can dissolve into the titanium resulting in a dense, stable alpha phase on the surface of the golf club head. The oxygen stabilized alpha phase formed on the surface is commonly called the "alpha case." The oxygen-stabilized alpha case is strong and exceptionally hard, however, it is also very brittle Heretofore state of the art titanium drivers have been manufactured and sold with the alpha case in place. Indeed metalagraphic examination of three leading titanium drivers indicate that the alpha case left on the front wall of state of the art titanium drivers is from 0.001 to 0.010 inches thick on each side of the wall. Face cracking of titanium drivers is the predominant failure mode of these clubs and has led to numerous designs for reinforcing the front wall using ribs, cantilevered supports, and exotic variable wall thickness designs. Nevertheless, face cracking still constitutes a serious problem for the designs of state of the art titanium clubs. The inventor of the present invention determined that although the alpha case is quite hard and durable, and therefore intuitively a good club surface, the brittleness of alpha case makes it a potential point source for crack propagation, which, due to the inherent notch sensitivity of titanium could lead to rapid failure in service, especially in high impact environments.

The inventor of the present invention has determined that where a golf club head is manufactured with a titanium striking surface, the golf club could be made stronger by actually removing the alpha case even though the resulting wall thickness of the striking surface would actually be thinner than the wall thickness of the club with the alpha case. This is because, although the front wall of the club is thinner, the resulting striking surface is more ductile, and less crack prone, than a thicker wall surface with the alpha case intact. The inventor of the present invention also determined that by removing the alpha case (without removing the underlying ductile titanium alloy) enough weight is saved in the casting that a separate weight member could be attached to the sole plate of the finished club to permit fine tuning of the center of mass and polar moment of inertia of the finished club.

SUMMARY OF THE INVENTION

The present invention comprises a method of making a golf club head comprising forming the body of a golf club head by casting a molten titanium alloy in a mold and allowing the molten titanium to solidify. The titanium will unavoidably form an alpha case, which may typically be from 0.001–0.010 inch in thickness on a front wall that may be from 0.040 inches in thickness at its thinnest point to 0.180 inches in thickness at its thickest point and on the club body which may be as thin as 0.030 inch in certain locations. The alpha case is then removed by a conformal milling process, which uniformly dissolves the alpha case without distorting the underlying metal. According to one embodiment of the present invention, the alpha case is removed by a chemical milling process in which the casting is immersed in an aquious solution of hydrofluoric acid (HF) hydrofluoric/nitric acid (HF—$HNO_3$); hydrofluoric/chromic acid (HF—$CrO_3$) or similar acid solutions. The chemical milling process removes the alpha case uniformly over the entire surface of the part resulting in thinner wall sections but no significant distortion of the part from its as-cast profile. According to another embodiment of the present invention, the alpha case is removed by a plasma milling process in which the part is exposed to a gas such as carbon tetrafluoride ($CF_4$), sulfur hexafluoride ($SF_6$) or other halide gas in a high vacuum environment at elevated temperature. As with chemical milling, plasma milling uniformly removes the alpha case, resulting in thinner cross sections but no significant distortion of the part from its as-cast profile. Additionally, plasma milling has the added advantages of being selective for the oxygen embrittled alpha case and not the pure titanium alloy substrate and further, provided the gaseous mixture does not contain hydrogen, will not cause hydrogen embrittlement of the underlying substrate.

Irrespective of the method by which the alpha case is removed, the reduction in wall thickness results in a concomitant reduction in the weight of the part without any loss in the critical impact strength of the part (in fact, impact strength is increased). The reduction in the weight of the part can then be redistributed as a supplemental weight member, which can be attached to the sole plate of the club or cast as an integral part of the sole plate or as part of the lower surface of the body of the club, thereby lowering the center of mass of the club. The weight member can further be positioned on the sole plate or club body in such a way so as to permit fine tuning of the location of the center of mass of the club, as well as shaped so as to increase the polar moment of inertia of the club head about the golf club shaft. Thus, the combination of chemical milling of the golf club head and redistribution of the weight saved by removing the alpha case results in a more durable high performance golf club head having an increased polar moment of inertia for stability as well as a lower center of mass that can be adjusted to provide an adjustable launch angle.

BRIEF DESCRIPTION OF THE DRAWING

The present invention will be better understood from a reading of the following detailed description, taken in conjunction with the accompanying drawing FIGS. in which like references designate like elements, and in which.

DETAILED DESCRIPTION

Figure 1:
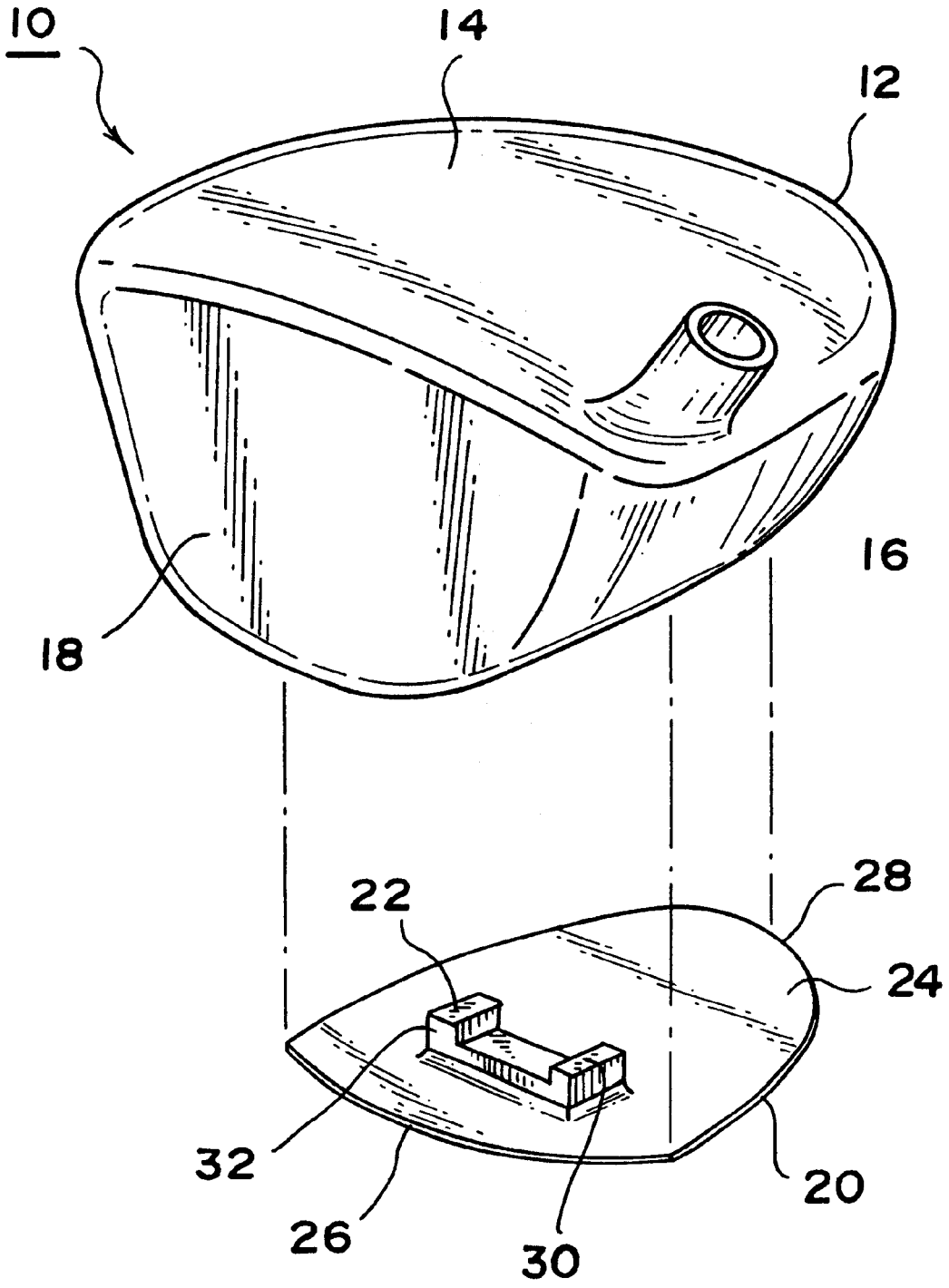
FIG. 1 is a partially exploded perspective view of a golf club incorporating features of the present invention.
Figure 2:
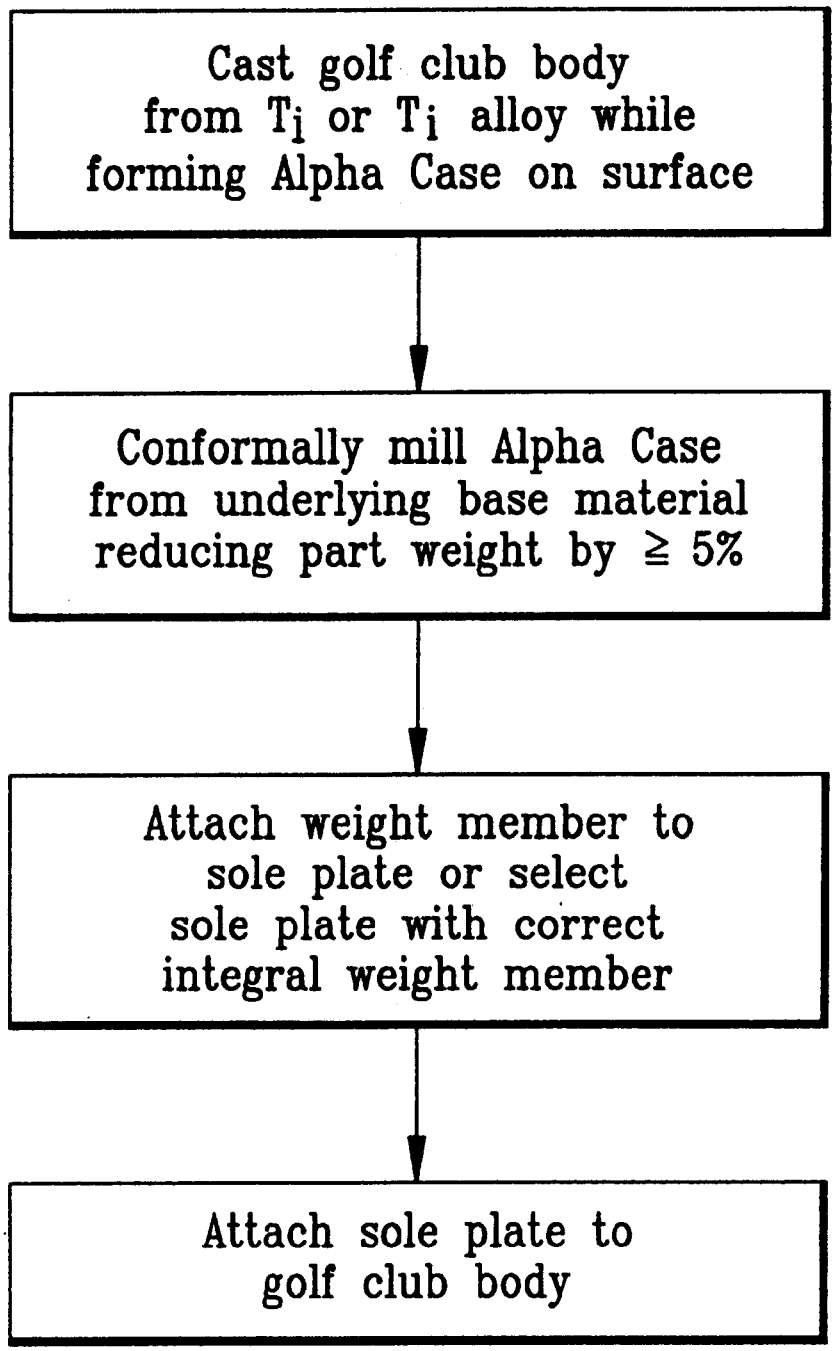
FIG. 2 is a summary of process steps for manufacturing a golf club head according to the teachings of the present invention.

The drawing figures are intended to illustrate the general manner of construction and are not necessarily to scale. In the description and in the drawing figures, specific illustrative examples are shown and herein described in detail. It should be understood, however, that the drawing figures and detailed description are not intended to limit the invention to the particular form disclosed but are merely illustrative and are intended to teach one of ordinary skill how to make and/or use the invention claimed herein and for setting forth the best mode for carrying out the invention. With reference to FIG. 1, a golf club head 10 incorporating features of the present invention includes a body portion 12 made of a material such as titanium. Body portion 12 has a top wall 14, a side wall 16 and a front wall 18 with a variable face thickness such as disclosed in U.S. Pat. No. 5,954,596 to Noble, et. al and assigned to the assignee of the present invention. Golf club head 10 further comprises a sole plate 20 that is attached to the body portion 12 (e.g. by welding) to form the lower surface of golf club head 10. As discussed more fully hereinafter, sole plate 10 includes a weight member 22 which may be attached (e.g. by welding) to the inner surface 24 of sole plate 20. Alternatively, weight member 22 may be integrally cast as part of sole plate 20.

As noted hereinbefore, titanium alloys are used in high performance hollow metal wood golf club heads because of their relatively light weight, high absolute strength, and high strength-to-weight ratio. When titanium alloys are cast and/or heat treated, however, a dense tightly adherent oxide in the form of alpha case forms on the surface of the part. The oxide typically ranges in thickness from about 0.001 to about 0.010 inches in thickness. Alpha case is exceedingly hard, and, therefore might intuitively seem to be an ideal surface for a high performance golf club, much in the same way as case-hardened steel parts are conventionally utilized in high strength and high wear applications. It was determined by the inventor of the present invention, however, that although the oxygen-stabilized alpha case has a high ultimate tensile strength and is exceptionally hard, the alpha case is also brittle. Accordingly, the inventor of the present invention determined that for a high shock application such as the face of a hollow metal wood golf club, the brittle alpha case exacerbated the notch sensitivity of the titanium alloy such that the front face of a golf club is actually stronger and more durable with the alpha case removed, even though removal of the alpha case results in a wall that is in some cases is from about 4% to as much as 20% thinner in cross section and as much as 50% thinner in areas other than the club face.

In the illustrative embodiment, body portion 12 is made from a titanium casting alloy, however, other suitable methods of forming a titanium shell (e.g., forging) may be used in accordance with the teachings of the present invention. In the illustrative embodiment, body 12 in the as-cast condition has a weight of approximately 165 grams and has a front wall 18 having a thickness of from approximately 0.075 inches at the thinnest point to a thickness of approximately 0.180 inches at the thickest point. As noted hereinbefore, the casting the process inherently produces an alpha case ranging in thickness of from 0.001 to 0.010 inches in thickness depending upon the process used to form body 12. The hard, brittle alpha case is then removed from body 12 by subjecting body 12 to a conformal milling process. As used herein, a "conformal milling" process means and refers to chemical milling, plasma milling, or other physical process in which the alpha case is dissolved evenly from the surface of body 12 without significant distortion of the underlying metal.

According to an illustrative embodiment comprising chemical milling, body 12 is mechanically or chemically conditioned to remove scale (amorphous oxide) and thereafter finished by immersion in an acid solution composed of ten to thirty percent (by volume) of seventy percent nitric acid solution and one to three percent (by volume) of sixty percent hydrofluoric acid at modestly elevated temperature. The rate at which the alpha case is removed from the surface of body 12 is a function of the acid concentration, temperature of the acid bath, weight of agitation, and other factors well-known in the metal finishing art. In the nitric acid/hydrofluoric acid solution, the ratio of nitric acid to hydrofluoric acid should be maintained at precisely ten to one to minimize hydrogen embrittlement of the titanium alloy substrate as the alpha case is removed. Methods of descaling and cleaning titanium are covered in detail in ASTM B600-91.

In the illustrative embodiment, the finished weight of body portion 12 after the alpha case is removed is 140 plus or minus two grams. Thus, the removal of the alpha case causes an approximately fifteen percent reduction in the weight of body portion 12. This fifteen percent weight reduction (approximately 25 grams) enables a 25-gram weight member 22 to be distributed in a location that will improve the performance of the golf club as more fully discussed hereinafter.

In an alternative embodiment, the conformal milling process comprises a plasma milling process such as is described in U.S. Pat. No. 6,010,635 to Goode et. al. In the plasma milling process, the surface of body portion 12 is cleaned using conventional techniques to remove surface grime and dirt. Body 12 is then placed in a plasma chamber which is evacuated to a high vacuum of about 0.1–0.3 milliTorr. The source gas from which the plasma is formed (e.g., $CF_4$, $SF_6$, $NF_3$ or other halide containing gas) is introduced into the chamber at a flow rate sufficient to produce a useful concentration of the plasma etching ions. Body 12 is heated to about 300° C. while exposed to a radio frequency discharge of about one watt per centimeter until all of the alpha case is removed. As with the chemical milling process, the resulting finished body portion 12 has a weight of 140 plus or minus two grams and therefore the 25 grams of alpha case removed are available for redistribution as a weight member 22 for increasing the polar moment of inertia of club 10 as well as tailoring the location of the center of mass of golf club head 10.

Figure 3:
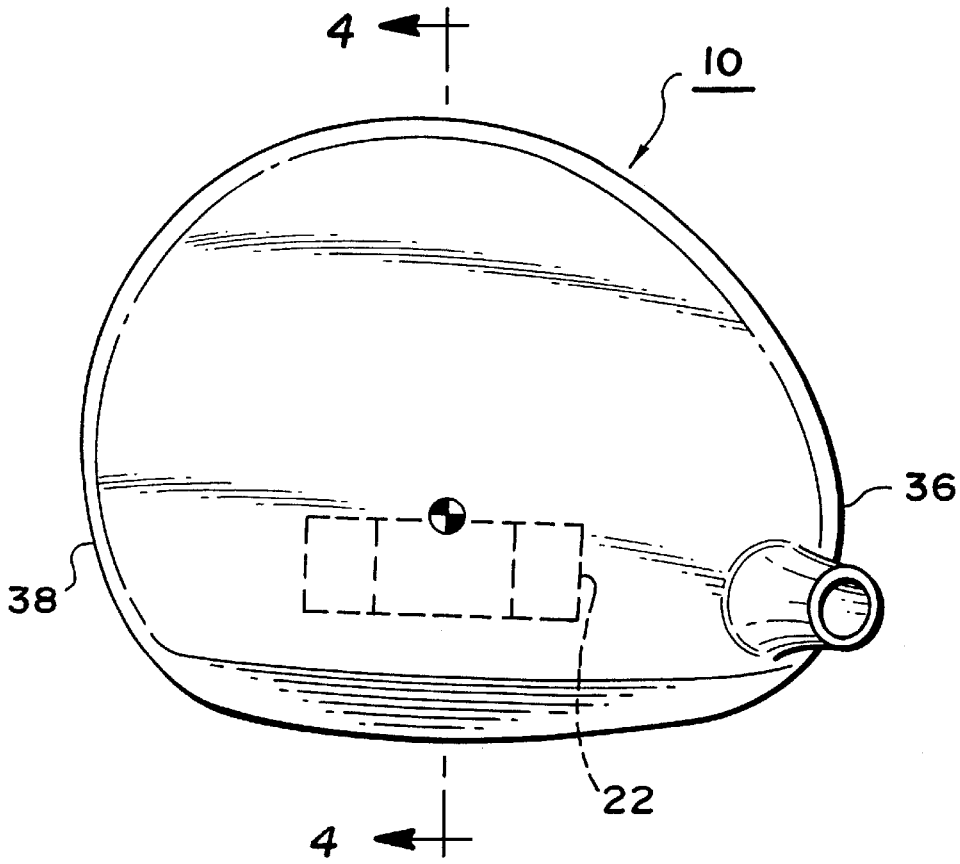
FIG. 3 is a top view of the golf club of FIG. 1.
Figure 4:
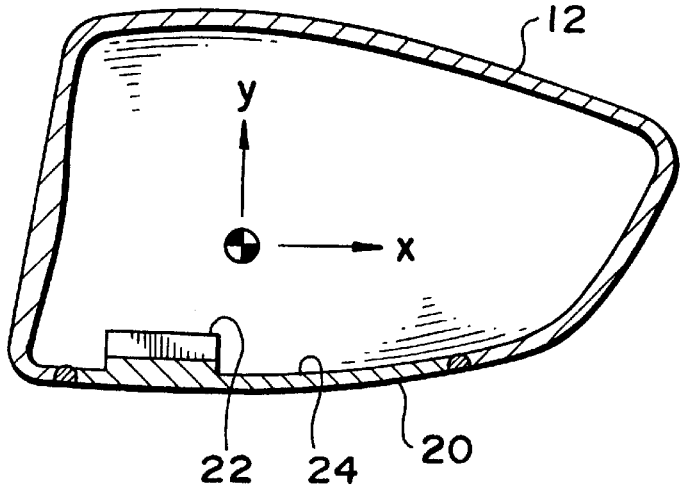
FIG. 4 is a cross sectional view of the golf club of FIG. 3 taken along line 4—4.

With reference to FIGS. 3 and 4, the 25 grams of alpha case removed from body portion 12 (as well as any weight savings from removal of the alpha case from sole plate 20) may be redistributed in the form of weight member 22. In the illustrative embodiment weight member 22 comprises a parallelepiped having a square "C" cross section (when viewed from the front of golf club head 10). Weight member 22 may be formed of tungsten, zirconium or other dense material that is bonded or welded to inner surface 24 of sole plate 20. Sole plate 20 itself may be made of titanium or, preferably, zirconium, which is denser than titanium and therefore lowers the center of mass of the assembled club head 10. Weight member 22 may be located either near leading edge 26 or near trailing edge 28 of sole plate 20 or in any one of a plurality of locations disposed between leading edge 26 and trailing edge 28 depending upon the desired location of the center of mass of the finished golf club head 10. Moving weight member 22 toward leading edge 26 will, naturally, move the center of mass of golf club head closer to face 18 of golf club head 10. Similarly, moving weight member 22 toward trailing edge 28 will cause center of mass of golf club head 10 to be further away from front wall 18 of golf club head 10. Moving of weight member 22 relative to sole plate 20 and the concomitant movement of the center of mass of golf club head 10 can be utilized to effect the dynamic coupling between golf club head 10 and a struck ball thus influencing the launch angle of the ball either upward or downward, depending upon the desire of the particular golfer. Additionally, the "C" shaped cross section of weight member 22, with mass concentrations 30 and 32 disposed in a spaced-apart configuration provides a higher polar moment of inertia about the Y axis (FIG. 4) than would a rectangular parallelepiped (i.e. of uniform thickness). The increase in the polar moment of inertia provides increased resistance to rotation or twisting of the golf club head in the event of an off-center impact with the golf ball. Thus, the increase in polar moment of inertia afforded by weight member 22, which is the direct result of the weight saved by removing the brittle alpha case from sole plate 20 and/or body portion 12, contributes both to the stability of the club in resisting twisting and improved launch angle as the result of relocating the center of mass of golf club head 10. Although in the illustrative embodiment weight member 22 is tungsten, other materials including zirconium, which could be welded to inner surface 24 of sole plate 20 or, alternatively, a plurality of sole plates 20 each having an integrally cast weight member 22 located in a different position disposed between leading edge 26 and trailing edge 28 of sole plate 20 are possible and considered within the scope of the present invention. Additionally, although weight member 22 in the illustrative embodiment is a parallelepiped having a C shaped cross section, any concentrated mass would accomplish the purpose of relocating the center of mass of club head 10 downward and be adjustable to move the center of mass forward and backward relative to front wall 18. Moreover, any shape including a rectangular parallelepiped or even two separate mass concentrations 30 and 32 disposed in a spaced-apart configuration toward the heel 36 and toe 38 of golf club head 10, or alternatively, casting thicker walls at the heel 36 and toe 38 of body portion 12, would serve the function of increasing the polar moment of inertia about the Y axis of golf club head 10. Accordingly, any configuration of weight member 22 disposed on sole plate 20 or body portion 12 made capable by removing the alpha case from the golf club head 10 is considered within the scope of the present invention.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention shall be limited only to the extent required by the appended claims and the rules and principles of applicable law.

What is claimed is:

1. A method of making a golf club head comprising:

forming a golf club body by casting a molten material chosen from the group consisting of titanium and alloys of titanium in a mold and allowing said molten material to solidify, once solidified, said golf club body comprising a hollow body having a face portion, a top wall, a side wall and a heel portion adapted to receive a golf club shaft, said face portion having a front surface and a rear surface, said face portion further comprising an alpha case and an underlying base material;

attaching a sole plate to said golf club body to form an assembled club comprising a hollow golf club head defining an outer surface and an inner surface, said sole plate including a weight member located on an inner surface thereof, said weight member having a center of gravity located beneath the center of gravity of said golf club body; and removing said alpha case from said golf club body by exposing said golf club body to a conformal milling process capable of selectively removing said alpha case such that a sufficient quantity of said alpha case is removed from said face portion so as to expose said underlying base material.

2. The method of claim 1, wherein:

said weight member is shaped such that the weight moment of inertia of said weight member relative to a longitudinal axis of said golf club shaft is greater than the weight moment of inertia of a circular cylinder.

3. The method of claim 2, further comprising:

selecting a weight member; and fixing said weight member to said inner surface of said sole plate in one of a plurality of possible locations, whereby the center of gravity of the assembled club can be moved toward or away from the face of the assembled club based on the location of said weight member relative to said sole plate.

4. The method of claim 2, further comprising:

selecting one of a plurality of sole plates each having an integral weight member located in a plurality of possible locations along said inner surface of said sole plate, whereby the center of gravity of the assembled club can be moved toward or away from the face of the assembled club based on the location of said integral weight member relative to said sole plate.

* * * * *